US007563995B2

(12) United States Patent
Jones

(10) Patent No.: US 7,563,995 B2
(45) Date of Patent: Jul. 21, 2009

(54) SAFETY SWITCH MOUNTING

(75) Inventor: Derek Jones, Galloway (GB)

(73) Assignee: Rockwell Automation Limited, Kiln Farm, Milton Keynes (GB)

( * ) Notice: Subject to any disclaimer, the term of this patent is extended or adjusted under 35 U.S.C. 154(b) by 70 days.

(21) Appl. No.: 11/960,174

(22) Filed: Dec. 19, 2007

(65) Prior Publication Data

US 2008/0164129 A1 Jul. 10, 2008

(51) Int. Cl.
*H01H 27/00* (2006.01)

(52) U.S. Cl. ..... 200/43.04; 200/43.07

(58) Field of Classification Search ... 200/43.01–43.07, 200/61.62, 17 R, 329, 334
See application file for complete search history.

(56) References Cited

U.S. PATENT DOCUMENTS

| | | | | |
|---|---|---|---|---|
| 5,420,385 | A * | 5/1995 | Cooper | 200/43.07 |
| 5,464,954 | A | 11/1995 | Kimura et al. | |
| 5,622,253 | A * | 4/1997 | Wecke et al. | 200/43.07 |
| 5,760,353 | A * | 6/1998 | Rapp | 200/17 R |
| 5,777,284 | A * | 7/1998 | Mohtasham | 200/43.04 |
| 6,037,551 | A * | 3/2000 | Fukui et al. | 200/43.04 |
| 6,118,087 | A * | 9/2000 | Fukui | 200/43.04 |
| 6,194,674 | B1 * | 2/2001 | Fukui | 200/43.04 |
| 6,307,167 | B1 * | 10/2001 | Kajio et al. | 200/43.11 |
| 6,720,508 | B2 * | 4/2004 | Moriyama et al. | 200/200 |
| 6,861,597 | B2 * | 3/2005 | Baechle | 200/43.04 |
| 6,872,898 | B2 * | 3/2005 | Mohtasham | 200/43.01 |
| 6,982,391 | B2 * | 1/2006 | Da Dalt | 200/43.04 |
| 7,339,125 | B2 * | 3/2008 | Day | 200/43.04 |
| 7,456,368 | B2 * | 11/2008 | Fukumoto et al. | 200/43.04 |
| 7,504,597 | B2 * | 3/2009 | Shimazu et al. | 200/43.04 |

FOREIGN PATENT DOCUMENTS

DE 3943376 6/1991

OTHER PUBLICATIONS

Search Report under Section 17 of Application No. GB0700146.4.

* cited by examiner

*Primary Examiner*—Michael A Friedhofer
*Assistant Examiner*—Lisa N Klaus
(74) *Attorney, Agent, or Firm*—Boyle Fredrickson LLP; William R. Walbrun

(57) ABSTRACT

A mounting arrangement includes a first mounting that is attachable to a first support structure and configured to cooperate with one of a safety switch and a safety switch actuator and a second mounting configured to cooperate with the other of the safety switch and the safety switch actuator. The first and second mountings provide variable guided interaction between the first and second mountings and thereby provided variable guided interaction between the safety switch and the safety switch actuator.

21 Claims, 7 Drawing Sheets

SAFETY SWITCH MOUNTING

CROSS-REFERENCE TO RELATED APPLICATIONS

This application claims priority to Great Britain patent application 0700146.4 filed on Jan. 5, 2007 and the disclosure of which is incorporated herein.

BACKGROUND OF THE INVENTION

The present invention relates to a mounting arrangement for a safety switch and a safety switch actuator.

Safety switches are well known, and are typically used to prevent access to, for example, electromechanical machinery when that machinery is in operation. In a conventional arrangement, the safety switch is mounted on a door post of a machinery guard, and an actuator for the safety switch is mounted on a corresponding door. When the door is closed, the actuator engages with the safety switch, which in turn closes a set of electrical contacts which allow power to be supplied to the machinery. This arrangement ensures that power can only be supplied to the machinery when the guard door is shut. When the guard door is opened, the actuator disengages from the safety switch, thereby opening the electrical contacts and cutting off the supply of power to the machinery.

A typical safety switch comprises a housing, in which is provided a set of contacts that are generally fixed in position relative to the housing. An axially slideable plunger is mounted inside the housing, and is moveable relative to the housing. The plunger is provided with another set of contacts. The plunger is biased towards a cam arrangement by a spring. The actuator mentioned above is arranged to engage with the cam arrangement.

In many safety switches, if the actuator is not engaged with the cam arrangement (i.e. if the actuator is not engaged with the safety switch), the cam arrangement is arranged to prevent the contacts on the plunger coming into contact with the contacts of the housing by preventing movement of the plunger (i.e. the plunger is kept in a first plunger position). By preventing the contacts from contacting one another, the switch cannot conduct electricity while the actuator is not engaged with the cam arrangement.

Bringing the actuator into engagement with the cam arrangement causes the cam arrangement to rotate, which in turn causes the plunger (which is biased toward the cam arrangement) to move into a notch provided in the cam arrangement. Such a configuration provides a plunger that is moveable between the first plunger position and a second plunger position. When the plunger moves into the notch, the contacts on the plunger are brought into contact with the contacts of the housing, allowing electricity to flow through the safety switch.

In order to ensure that the actuator is brought into engagement with the cam arrangement, the actuator must be directed through an opening in the housing of the safety switch. If for some reason the actuator is misaligned with the opening, when the door to the machinery guard is closed the actuator may not pass through the opening in the housing, but hit the housing. If the actuator hits the housing, one or both of the housing and the actuator may become damaged. Alignment of the actuator with respect to the opening of the housing can be made even more difficult if the door post to which the safety switch is mounted is vibrating, or if the door to which the actuator is mounted is vibrating. Misalignment of the actuator with the opening in the housing may also occur due to wear and tear of the door of the machinery guard. For example, the weight of the door to the machinery guard may cause the door to, over time, move in a vertical direction causing misalignment of the actuator relative to the opening in the housing.

Even when the actuator is satisfactorily aligned with the opening of the housing, and the actuator is brought into engagement with the cam arrangement of the safety switch, problems can still be encountered. Problems can occur if there is relative movement between the door to which the actuator is mounted and the door post to which the safety switch is mounted. For example, if the door moves vertically relative to the safety switch, the actuator may become bent, and/or the safety switch may be damaged or removed from the door post. In another example, if the door moves away from the door post due to vibrations caused by operating machinery, the actuator may be disengaged from the cam arrangement of the safety switch. Disengagement of the actuator from the safety switch causes the safety switch to turn off the supply of power to the machinery within the machinery guard. It is possible that, due to vibrations, this process of cutting off the supply of power to the machinery may be repetitious, i.e. following the cycle of the vibrations (e.g. the power supply to the machinery may 'flutter'). Even if the supply of power to the machinery is not interrupted, the movement of the actuator may cause wear on the cam arrangement, and other parts of the safety switch.

It is therefore desired to provide a reliable safety switch mechanism that has generally repeatable operating conditions and which overcomes one or more of these or other disadvantages.

SUMMARY OF THE INVENTION

According to a first aspect of the present invention, there is provided a mounting arrangement for use with a safety switch and a safety switch actuator. The mounting arrangement includes a first mounting attachable to a first support structure and arranged to be located adjacent to or attached to the safety switch. The first mounting is provided with a tapered aperture which tapers inwardly toward a channel located in the first mounting. The mounting arrangement includes a second mounting that includes an elongate guiding element configured to be received in the channel of the first mounting. A surface on which the safety switch actuator is attachable, such that the actuator and elongate guiding element extend in the same direction, parallel to one another and away from the mounting. The mounting arrangement includes a resilient member which attaches the second mounting to a second support structure.

Preferably, an end of the elongate guiding element that is to be received by the channel tapers inward. Preferably, the resilient member is a spring. Preferably, the spring is a helical spring.

Preferably, the mounting arrangement includes a catch mechanism. More preferably, the catch mechanism includes a snap-fit arrangement. Preferably, a catch is provided on the elongate guiding element. Preferably, a catch receiving portion is provided in a surface that defines a channel for receiving the catch of the elongate guiding element. Alternatively, a catch may be provided in the channel. In this alternative, the guiding element may include a catch receiving portion for receiving the catch in the channel. In either alternative, preferably the catch comprises a biasing element. Preferably, the catch further comprises a catching member connected to the biasing element. The catching member maybe a ball. Preferably, the catch receiving portion is a groove.

Preferably, the first mounting and second mounting are shaped such that, when the safety switch actuator is brought into engagement with the safety switch, the first mounting comes into contact with the second mounting.

The second mounting may be provided with a safety switch actuator.

The first support structure may be one of a group that includes a door post, a gate post, and a fence post. The second support structure may be one of a group including a door and a gate.

Alternatively, the second support structure may be one of a door post, a gate post, or a fence post. The first support structure may be one of a door or a gate.

According to a second aspect of the present invention, there is provided a mounting arrangement for use with a safety switch and a safety switch actuator. The mounting arrangement includes a first mounting and a second mounting. The first mounting is attachable to a first support structure and is arranged to be located adjacent to, or attached to, the safety switch. The first mounting is provided with an elongate guiding element that extends away from the first mounting. The second mounting includes a tapered aperture which tapers inwardly toward a channel located in the second mounting. The channel is configured to receive the elongate guiding element of the first mounting. The safety switch actuator is attachable on a surface such that the actuator and elongate guiding element extend in the same direction, parallel to one another and away from the mounting. The second mounting is attachable to a second support via a resilient member.

Preferably, an end of the elongate guiding element that is to be received by the channel tapers inwardly. Preferably, the resilient member is a spring. Preferably, the spring is a helical spring.

Preferably, the mounting arrangement includes a catch mechanism. Preferably, the catch mechanism is a snap-fit arrangement. Preferably, a catch is provided on the elongate guiding element. Preferably, a catch receiving portion is provided in a surface that defines the channel, for receiving the catch of the elongate guiding element. Alternatively, a catch may be provided in the channel. In this alternative, a catch receiving portion may be provided in the guiding element, for receiving the catch in the channel. In either alternative, preferably the catch comprises a biasing element. Preferably, the catch further comprises a catching member connected to the biasing element. The catching member may be a ball. Preferably, the catch receiving portion is a groove.

Preferably, the first mounting and second mounting are shaped such that, when the safety switch actuator is brought into engagement with the safety switch, the first mounting comes into contact with the second mounting. The second mounting may be provided with a safety switch actuator. One of the first support structure and the second support structure may be one of a door post, a gate post, and a fence post. The other of the first support structure and the second support structure may be one of a door and a gate.

These and other aspects and advantages of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

Embodiments of the present invention will now be described, by way of example only, with reference to the accompanying drawings, in which.

Figure 1:
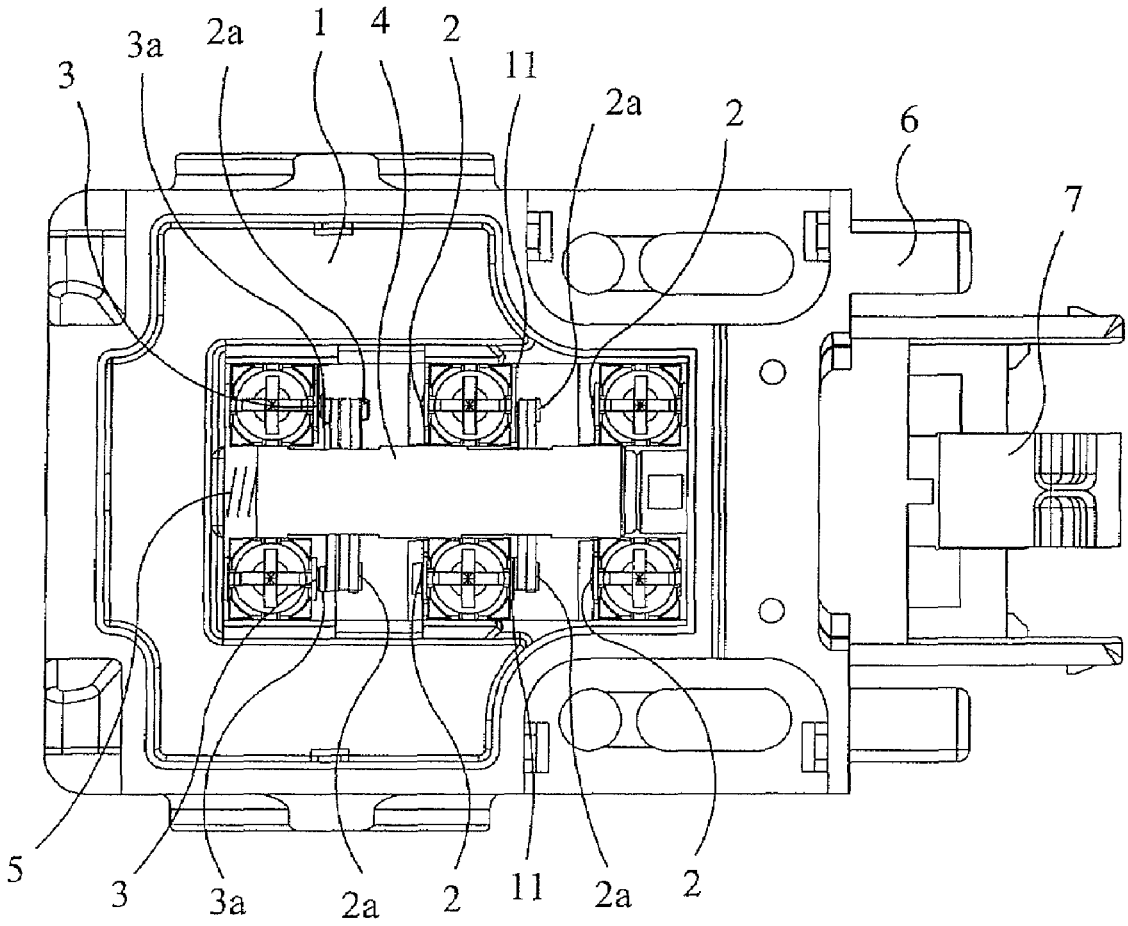
FIG 1 PRIOR ART
FIG. 1 depicts a safety switch for use with the mountings of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION

FIG. 1 depicts a plan view of a prior art safety switch. The safety switch comprises a two-part housing. One part of the housing defines a main body 1 of the safety switch. Mounted within the body 1 are electrical contacts which are fixed in position relative to the body 1. The contacts consist of two fixed safety contacts 2 and a fixed auxiliary contact 3. Also mounted within the body 1 is a plunger 4 which is slideable relative to the body 1 in an axial direction. The plunger 4 is provided with a plurality of contacts which extend through the plunger and which are moveable relative to the plunger 4. The moveable contacts include two moveable safety contacts 2*a* and a moveable auxiliary contact 3*a*. By moving the plunger 4, the moveable contacts 3*a*, 4*a* can be brought into contact (and thus electrical connection) with the fixed contacts 3, 4 of the safety switch. The plunger 4 is also provided with a moveable insulating barrier 11 which serves to provide additional electrical insulation for some of the moveable safety contacts 2*a*.

Figure 2A:
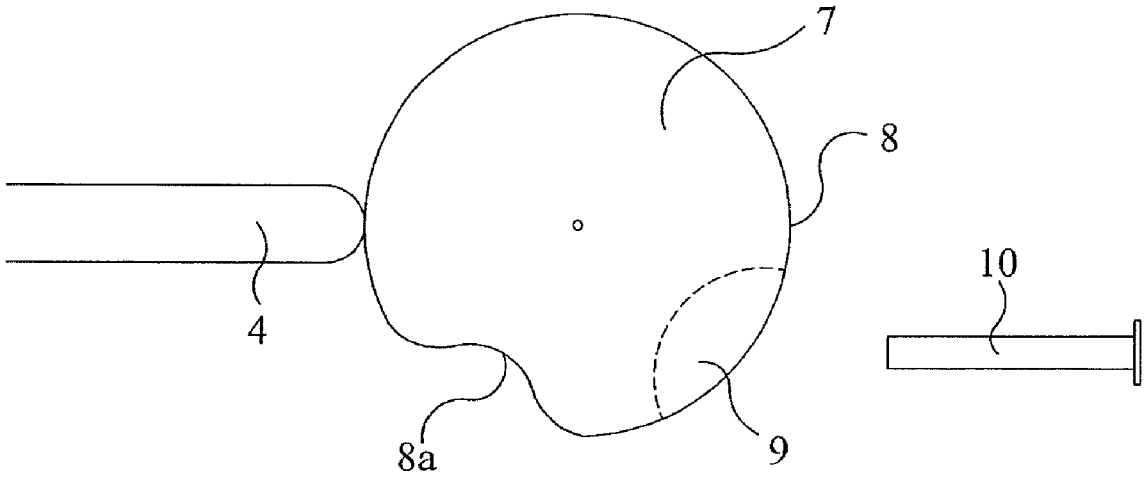
FIG 2a PRIOR ART
FIGS. 2*a* and 2*b* depict a cam arrangement of the safety switch of FIG. 1.
Figure 2B:
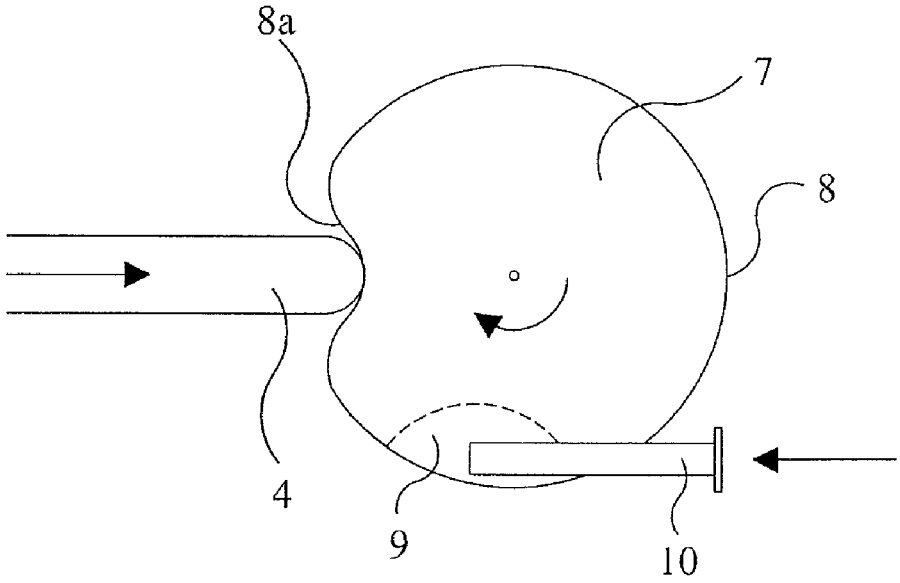
FIG 2b PRIOR ART

The plunger 4 is biased by a spring 5 towards a second part of the housing, which forms a head 6 of the safety switch. The head 6 of the safety switch is provided with a rotatable cam arrangement 7. The cam arrangement 7 is arranged to receive and engage with an actuator 10 (FIGS. 2*a* and 2*b*). Engagement or disengagement of the actuator with the cam arrangement 7 causes the cam arrangement 7 to rotate, which in turn causes axial movement of the plunger 4 within the body 1 of the safety switch.

FIGS. 2*a* and 2*b* illustrate the interaction between the cam arrangement 7 and the plunger 4 in more detail. FIG. 2*a* shows that the cam arrangement 7 defines a cam surface 8. The cam surface 8 is provided with an indentation 8*a* which is (upon rotation of the cam arrangement 7) arranged to receive the plunger 4. The cam arrangement 7 is also provided with a notch 9 for receiving and engaging with an actuator. It can be seen from FIG. 2*a* that, when no actuator is brought into engagement with the cam arrangement 7, the cam arrangement pushes back against the plunger 4 (which is biased toward the cam arrangement 7 by the spring 5) and prevents the plunger 4 from moving towards the cam arrangement 7. The plunger 4 is said to be in a first plunger position 12.

It can be seen from FIG. 1 (in combination with FIG. 2*a*) that when no actuator is brought into engagement with the cam arrangement 7 all of the fixed safety contacts 2 of the body 1 of the safety switch are kept apart from all of the moveable safety contacts 2*a* of the plunger 4. Thus, when no actuator is engaged with the cam arrangement 7, the safety contacts 2, 2*a* are not in electrical connection with each other, which prevents the safety switch from conducting electricity (to, for example, electrically powered machinery with a machine guard). When no actuator is engaged, the auxiliary contacts 3, 3*a* are in contact with each other, which may allow an auxiliary power supply to be supplied to the switch (for example, to power a light which indicates that no actuator has been engaged with the switch).

FIG. 2*b* depicts an actuator 10 that has been brought into engagement with the cam arrangement 7. It can be seen from FIG. 2*b* that when the actuator 10 has been brought into engagement with the cam arrangement 7, the cam arrangement 7 and therefore cam surface 8 is arranged to rotate in a clockwise direction. Rotation of the cam arrangement 7 causes the indentation 8*a* in the cam surface 8 to be brought into alignment with the plunger 4. As the indentation 8*a* moves into alignment with the plunger 4, which is biased by the spring 5, the plunger 4 moves towards the right of FIG. 2*b*. The plunger 4 is said to be in a second plunger position 14.

Figure 3:
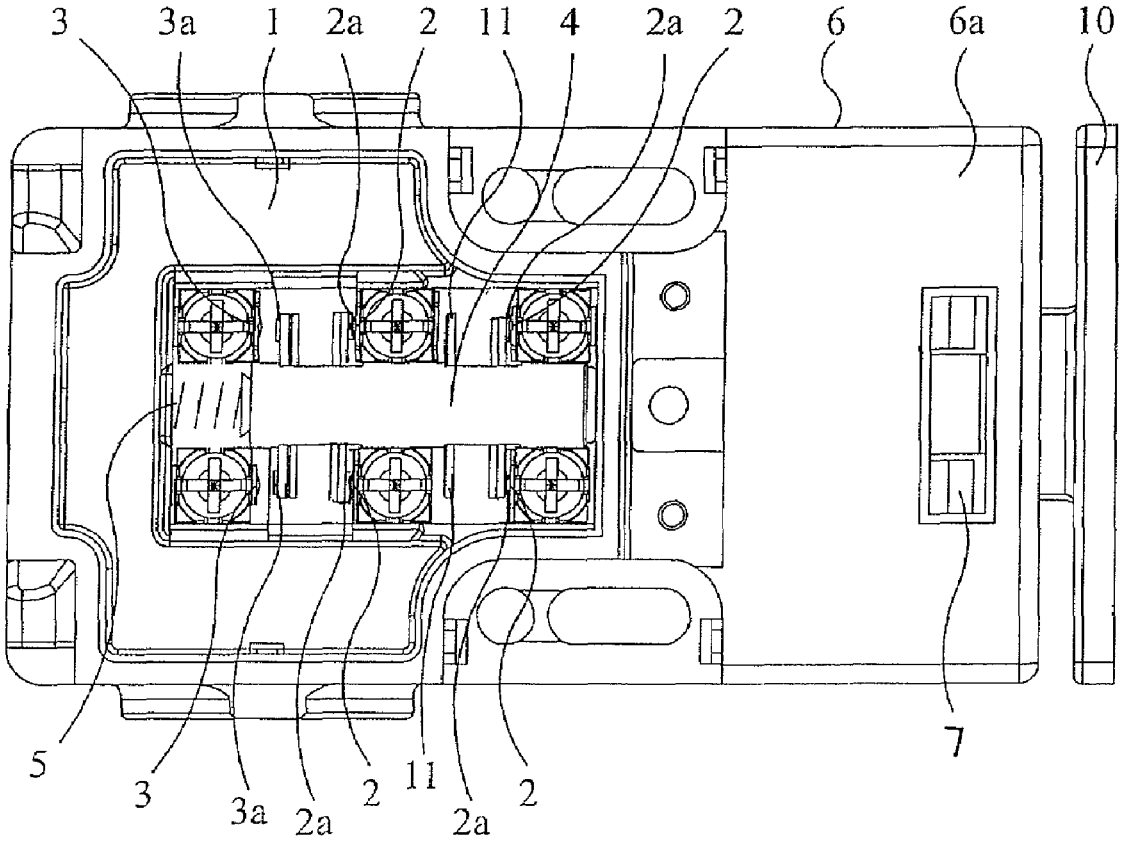
FIG 3 PRIOR ART
FIG. 3 depicts operating principles of the safety switch of FIG. 1.

FIG. 3 shows the safety switch with an end cap 6*a* enclosing the head 6 of the safety switch. The end cap 6*a* protects the cam arrangement 7 from damage, dust etc. and makes the safety switch appear more aesthetically pleasing. It can be seen from FIG. 3 that when the actuator 10 is brought into engagement with the cam arrangement 7, the plunger 4 moves towards the right of FIG. 3. When the plunger 4 moves to the right, all of the moveable safety contacts 2*a* are brought into electrical connection with the fixed safety contacts 2 of the body 1 of the safety switch. When all of the safety contacts 2, 2*a* are brought into electrical connection with each other, the switch is capable of conducting electricity (to, for example, electrically powered machinery with a machine guard). The safety switch is configured such that if one or more of the safety contacts 2, 2*a* are not in electrical connection with each other, the switch is incapable of conducting electricity.

Figure 4A:
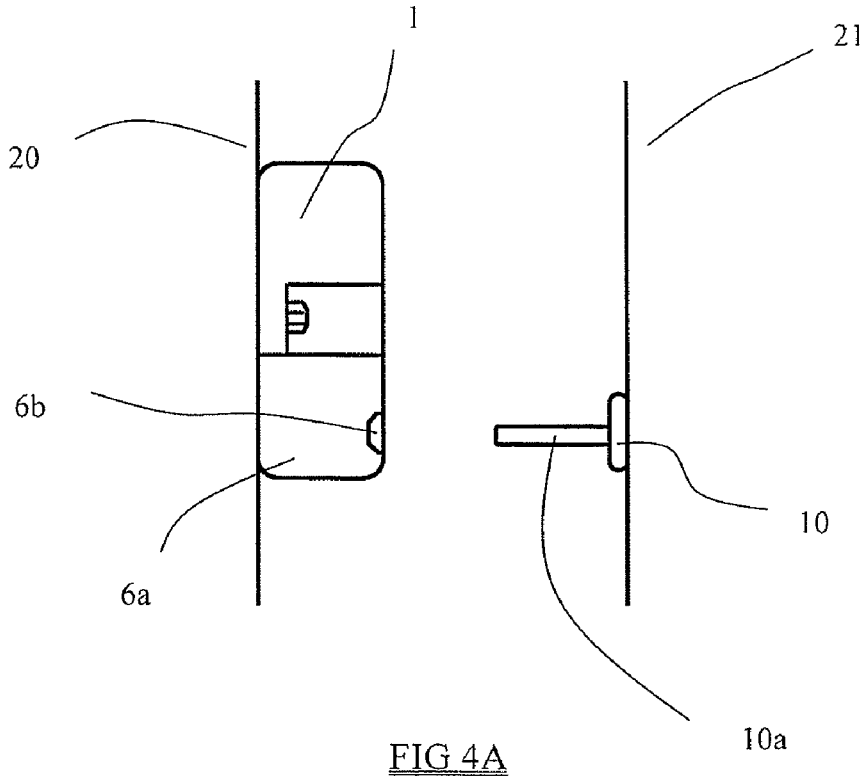
FIG 4A PRIOR ART
FIGS. 4*a* and 4*b* depict use of the safety switch of FIG. 1.

FIG. 4*a* illustrates the safety switch of FIG. 1 mounted to a door post 20 of a machinery guard. The actuator 10 of FIGS. 2 and 3 is shown mounted on a door 21 of the machinery guard. The end cap 6*a* of the safety switch is provided with an opening 6*b* (e.g. a slot), through which the actuator 10 may pass and engage with the cam arrangement located within the end cap 6*a*. For clarity, the cam arrangement is not shown in this Figure. The actuator 10 is mounted on the door 21 in direct alignment with the opening 6*b* of the safety switch. When the door 21 to the machinery guard is closed, a protruding part 10*a* of the actuator 10 passes through the opening 6*b* of a safety switch, and into engagement with the cam arrangement to allow the safety switch to conduct electricity.

Figure 4B:
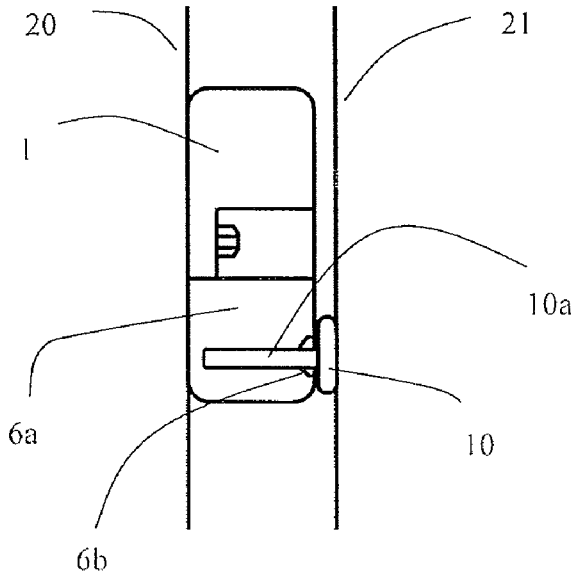
FIG 4B PRIOR ART

FIG. 4*b* shows the door 21 in a closed position. It can be seen that the protruding part 10*a* of the actuator 10 has passed through the opening 6*b* and into engagement with the cam arrangement of the safety switch 1.

There are a number of problems with the arrangement illustrated in FIGS. 4*a* and 4*b*. For example, if the actuator 10 is not correctly aligned with the opening 6*b* of the safety switch, the actuator 10 will hit the housing 1 of the safety switch when the door 21 to the machinery guard is closed. The protruding part 10*a* of the actuator 10 may damage the housing of the safety switch, or even the internal workings of the safety switch (for example, the cam arrangement). Actuator 10 may also become damaged. Even if the actuator 10 is only slightly misaligned with the centre of the opening 6*b*, such that the actuator 10 can still be brought into engagement with the cam arrangement of the safety switch, the slight misalignment may nevertheless cause repetitive wear of the housing 1 of the safety switch, or even its internal workings.

Even if the actuator 10 is correctly aligned with the opening 6*b* of the safety switch, there may still be problems with the mounting arrangement shown in FIGS. 4*a* and 4*b*. For example, if the door 21 to the machine guard is closed with sufficient force, parts of the door 21, or even the actuator 10, can hit the safety switch 1 and damage the safety switch. If the actuator 10 has been brought into engagement with the cam arrangement of the safety switch, the actuator 10 can become damaged (e.g. bent) if the door 21 of the machinery guard moves in a vertical or horizontal direction. If there is relative movement between the actuator 10 and the safety switch, for example due to vibrations of the door 21, the actuator 10 may repeatedly hit or move the cam arrangement or housing 1 of the safety switch, which can cause damage to these features. It is possible that even slight movement of the actuator 10 towards and away from the safety switch (caused, for example, by vibration of the door 21) can cause the cam arrangement to move, which may cause the contacts within the safety switch to undesirably open or close. If the contacts open and close repeatedly (for example, due to vibration of the actuator), the power supply to the machinery within the machinery guard will be interrupted repeatedly. Such repetitious interruption of the power supply may damage the machinery and/or cause the machinery to operate in a non-continuous, and likely undesirable, manner.

Figure 5A:
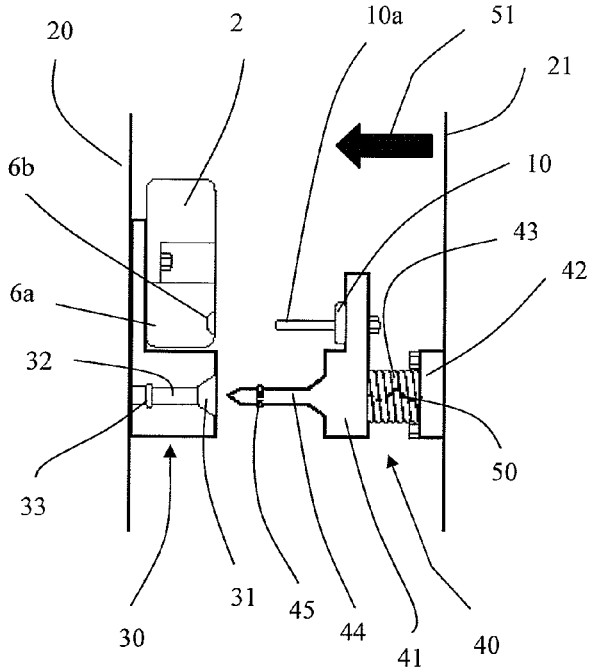
FIGS. 5, 6 and 7 depict mountings according to embodiments of the present invention, for use with a safety switch, and use of those mountings.
Figure 5B:
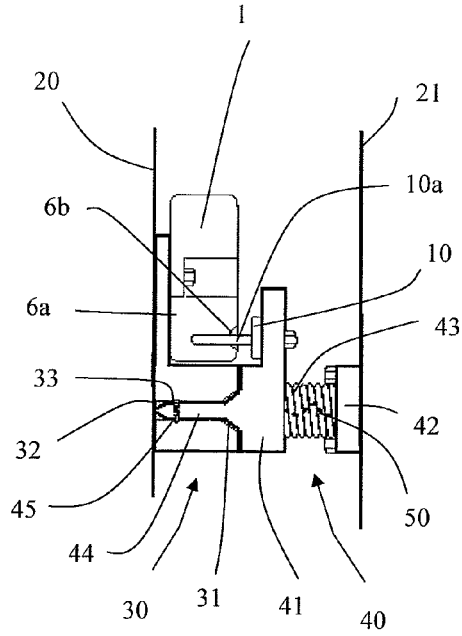
Figure 5C:
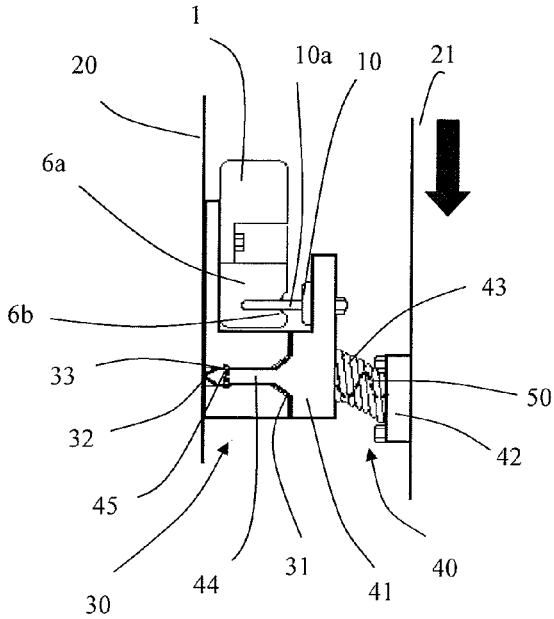

FIGS. 5*a* to 5*c* illustrate a safety switch and actuator arrangement according to an embodiment of the present invention. FIG. 5*a* illustrates a safety switch 1 and actuator 10 constructed generally in accordance with the description provided above. However, in contrast to the arrangement of FIGS. 4*a* and 4*b*, the safety switch and actuator 10 are not attached directly to the door post 20 and door 21 respectively, but instead attached to the door post 20 and door 21 via mountings 30, 40. The safety switch 1 is attached to the door post 20 via a first mounting 30 (hereinafter referred to as "the safety switch mounting 30"). The actuator 10 is attached to the door 21 via a second mounting 40 (hereinafter referred to as "the actuator mounting 40").

The safety switch mounting 30 is substantially L-shaped. The safety switch mounting 30 is shaped to accommodate a safety switch, which sits in a corner formed by the L-shaped safety switch mounting 30. The back-side of the L-shaped safety switch mounting 30 is attached to the door post 20, and is thinner than the bottom of the L-shaped safety switch mounting 30. The bottom of the L-shaped safety switch mounting 30 is provided with a tapered aperture 31. The tapered aperture 31 tapers inwards towards a channel 32. The channel 32 extends away from the tapered aperture 31 towards the back-side of the L-shaped safety switch mounting 30. At an end of the channel 32, near the back of the L-shaped safety switch mounting 30 (i.e. away from the tapered aperture 31), there is provided an annular groove 33 which extends about the circumference of the channel 32. The lower part, or base, of the L-shaped safety switch mounting 30 is dimensioned such that it is approximately equal to the depth of the safety switch 1 (i.e. the distance which the safety switch 1 extends away from the door post 20), or such that it slightly exceeds the depth of the safety switch 1.

The safety switch mounting 30 may be made from any appropriate materials. For example, the safety switch mounting 30 may be made from metal, plastic or any durable material.

The actuator mounting 40 comprises a first part 41 which is connected to a second part 42 by a helical spring 43 and a steel cable 50 which extends through the helical spring 43. The second part 42 of the actuator mounting 40 is attached to the door 21, such that the first part 41 of the actuator mounting 40 extends towards the safety switch mounting 30. The first part 41 of the actuator mounting 40 is provided with an elongate guiding element 44. The elongate guiding element 44 is shaped to conform to the inner surfaces of the tapered aperture 31 and channel 32 of the safety switch mounting 30. An end of the elongate guiding element 44 is shaped to taper to a point, to aid engagement with the tapered aperture 31 of the safety switch mounting (described in more detail below). The elongate guiding element 44 is also provided with a catch 45 which is positioned and shaped to engage with the groove 33 of the safety switch mounting 30. It can be seen from FIG. 5*a* that a section of the first part 41 of the actuator mounting 40 extends perpendicularly away from the elongate guiding element 44. Attached to this section is the actuator 10, the actuator 10 being positioned such that the actuator 10 and elongate guiding element 44 both extend parallel to one another and towards the safety switch mounting 30. The elongate guiding element 44 extends further away from the first part 41 than does the actuator 10.

The first part 41 and second part 42 of the actuator mounting 40 may be made from any suitable material. For example, the first part 41 and second part 42 of the actuator mounting 40 may be made from metal, plastic or any durable material.

In order to bring the actuator 10 into engagement with the safety switch 1, the door 21 is moved towards the safety switch 1 in the actions shown by the arrow 51. FIG. 5*b* depicts the situation when the actuator 10 has been brought into engagement with the safety switch 1. It can be seen that not only is the actuator 10 engaged with the safety switch 1, but also that the elongate guiding element 44 is engaged with the channel 32 and tapered aperture 31 of the safety switch mounting 30. As shown, the separation of the actuator 10 and the elongate guiding element 44 is chosen such that if the elongate guiding element 44 is received by the guide or channel 32 and tapered aperture 31 of the safety switch mounting 30, the actuator 10 of the actuator mounting 40 will also be received by the opening 6*b* in the safety switch 1. Since the elongate guiding element 44 extends further away from the first part 41 than does the actuator 10, if the elongate guiding element 44 is brought into engagement with the channel 32 and the tapered aperture 31 of the safety switch mounting 30, the actuator 10 of the actuator mounting 40 will also be brought into engagement with the opening 6*b* in the safety switch 1. This is described in more detail below.

If for some reason the actuator 10 is not accurately aligned with the opening 6*b* in the safety switch 1 before the door 21 to the machinery guard is closed, the actuator would, in prior art arrangements, hit the body of the safety switch 1. However, using the arrangement of the present invention, this situation is avoided. When arranged according to embodiments of the present invention, if the actuator 10 is slightly misaligned with the opening 6*b*, the elongate guiding element 44 will also be slightly misaligned with respect to the channel 32. It can be seen from FIGS. 5*a* and 5*b* that the elongate guiding element 44 extends further in the direction of the safety switch mounting 30 than does the actuator 10. The elongate guiding element 44 is therefore brought into engagement with the tapered aperture 31 and channel 32 of the safety switch mounting 30 before the actuator 10 has had a chance to hit the safety switch 1 (or alternatively, before the actuator 10 has been brought into engagement with the safety switch 1). If the actuator 10 and therefore elongate guiding element 44 are slightly misaligned, the elongate guiding element 44 will be guided into the channel 32 by the tapered aperture 31, which will in turn cause the actuator 10 to be accurately aligned and brought into engagement with the opening 6*b* in the safety switch 1. The spring 43 of the actuator mounting 40 allows movement of the first part 41 of the actuator mounting 40, and therefore movement of the actuator 10 and elongate guiding element 44.

If the door 21 to the machinery guard is closed with excessive force, it can be seen from FIG. 5*b* that this force will be dissipated through the actuator mounting 40 and safety switch mounting 30. This is because the safety switch 1 is accommodated in the L-shaped safety switch mounting 30, where the lower part of the L-shaped safety switch mounting 30 extends beyond the depth of the safety switch 1. Therefore, when the door 21 to the machinery guard is closed, the actuator mounting 40 will come into contact with the lower part of the safety switch mounting 30, and not the safety switch 1 itself.

In prior art arrangements, if the door to the machinery guard moves in a vertical direction, the actuator and/or safety switch may become damaged (e.g. the actuator may bend). This is not the case with the arrangement in accordance with embodiments of the present invention. As can be seen in FIG. 5*c*, if the door 21 to the machinery guard moves in a vertical direction, this vertical movement is taken up by the spring 43, which prevents the actuator 10 from bending. If vertical movement of the door 21 is temporary, the spring 43 will return to its original shape when the door 21 moves to its original position. If movement of the door 21 in the vertical direction is permanent, the actuator 10 can still be accurately brought into engagement with the safety switch due to the nature of the tapered aperture 31 of the safety switch mounting 30, as described in relation to FIG. 5*b* above.

Figure 6A:
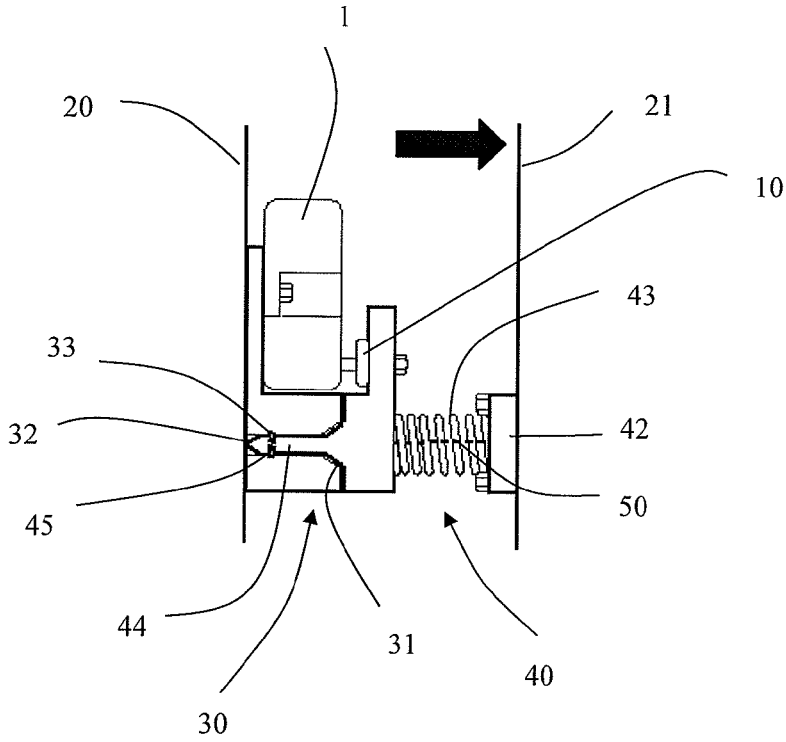
Figure 6B:
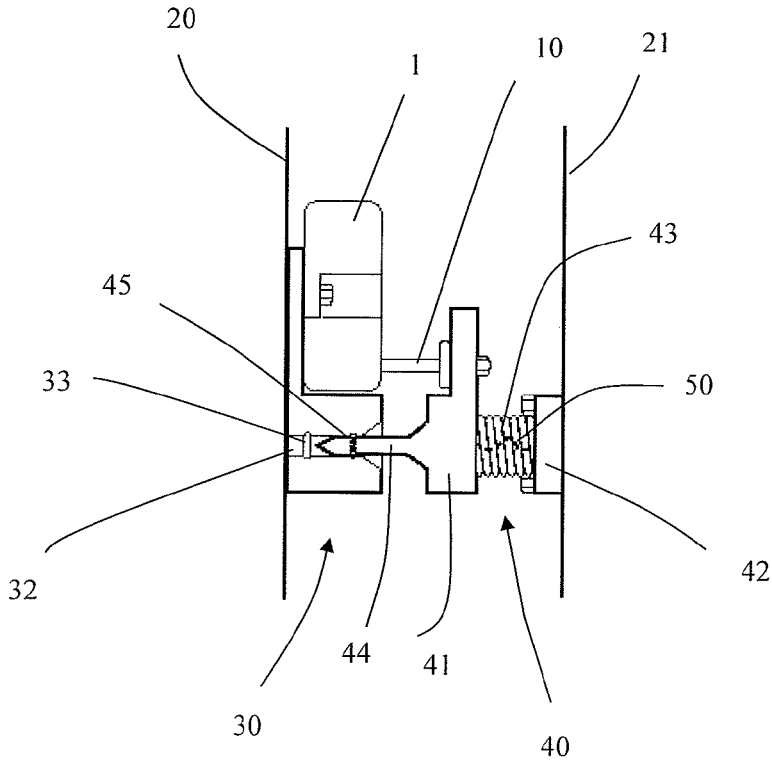

In prior art arrangements, if the door to the machinery guard moves towards and away from the safety switch, the safety switch and/or the actuator may become damaged, or alternatively the power supply to the machinery within the machine guard may be repeatedly interrupted. This is not the case with the arrangement according to embodiments of the present invention. In some prior art safety switches, two set of contacts are employed and are monitored by monitoring apparatus. If one of the sets of contacts fails (e.g. short circuits, or becomes welded together) the monitoring apparatus detects this, and prevents the safety switch from conducting electricity until, for example, the switch is inspected and possible reset or fixed. In prior art safety switches, movement of the door to the machinery guard towards and away from the safety switch can cause one or both of the contacts to move at different times. The monitoring apparatus may deem this to be a fault in one or both contacts, and prevent the safety switch from conducting electricity. This is sometimes referred to as false-tripping of the safety switch. This scenario is avoided using the arrangement according to embodiments of the present invention. Referring to FIG. 6*a*, if the door 21 repeatedly moves towards and away from the safety switch 1, this movement will be taken up by the spring 43, and will not cause movement of the actuator 10. As can be seen in FIG. 6*b*, only when sufficient force is applied to the door 21 to overcome the catch 45 is the elongate guiding element 44 removed from the channel 32, and also the actuator 10 disengaged from the safety switch 1. Therefore, the actuator 10 may not be slightly disengaged from the safety switch 1, or repeatedly engaged and disengaged, but can be only be disengaged in a single quick, sharp motion when sufficient force is applied to the door 21 to overcome the catch 45.

The steel cable 50 shown in the Figures may act in co-operation with the spring 43, or as a backup to the spring 43. If the spring 43 is not sufficiently stiff (i.e. if the spring is not strong enough, for example due to wear and tear), movement of the door 21 away from the door post 20 may not cause the elongate guiding element 44 to be removed from the channel 32. Instead, the spring 43 may become stretched. However, even if this happens, the steel cable 50 will, when pulled taught, remove the elongate guiding element 44 from the channel 32, and also disengage the actuator 10 from the safety switch 1, in a single quick, sharp motion. Similarly, even if the spring 43 should break (e.g., from wear and tear), the steel cable 50 ensures that the elongate guiding element 44 may be removed from the channel 32, and the actuator 10 disengaged from the safety switch 1. In summary, the optional steel cable 50 increases the surety that, by opening the door 21 to a sufficient extent and with sufficient force to overcome the catch 45, the actuator 10 can be withdrawn from the safety switch 1. If a cable (or any other suitable connector) is employed, it may be made from any suitable material. Preferably the material is relatively inelastic when subject to tensile forces along its length. Preferably, the connector may change shape as the spring 43 expands and contracts, for example coiling or uncoiling.

Figure 7:
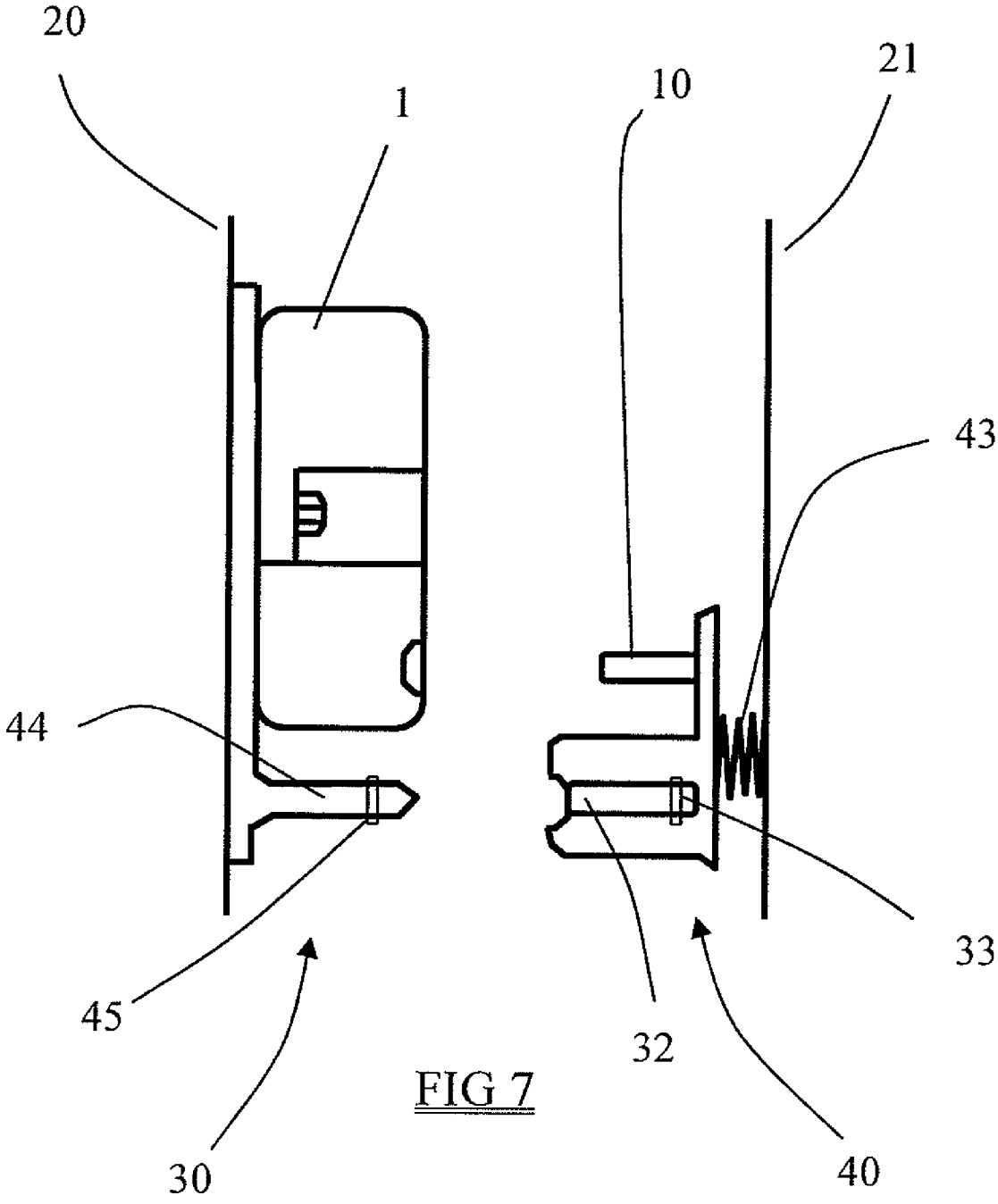

In the embodiments describe above, the elongate guiding element 44 has been described as being part of the actuator mounting 40, and the channel 32 and tapered aperture 31 as being part of the safety switch mounting 30. Understandably, and the elongate guiding element 44 could be part of the actuator mounting 34, and the channel 32 and tapered aperture 31 be part of the actuator mounting 40. This alternative embodiment is shown in FIG. 7. The arrangement shown in FIG. 7 may have all the features (and variations on those features) described above and below.

In the embodiments describe above, the helical spring 43 has been described as the element which allows movement of the first part 41 of the actuator mounting 40. Understandably, a spring and a coil spring, are only examples of a suitable resilient member. For example, in some situations a body of rubber may be sufficiently malleable and elastic to be a suitable replacement for the spring 43.

In the embodiments describe above, the elongate guiding element 44 is kept in the channel 32 during, for example, vibration of the door 21, due to the incorporation of the catch 45 and groove 33 arrangement. It will be appreciated that this arrangement can be any suitable catching arrangement. For example, the catch 45 may comprise one or more sprung balls which can be moved out of the groove 33 and into the elongate guiding element 44 by subjecting the elongate guiding element 44 to a sufficient force. Preferably, the catching arrangement is arranged such that, when overcome, the elongate guiding element 44 is readily removable from the channel 32. The catching arrangement is either engaged or disengaged, so that the elongate guiding element 44 can only be removed from the channel in a quick, snap like action such as a catch arrangement that is a snap fit. A catch may be provided on a surface defining the channel, with a catch receiving portion being provided on the elongate guiding element 44, or vice versa. However, it may be more practical to provide the catch receiving portion (e.g. a groove) inside the channel than it would be to provide a catch (e.g. a biased mechanism of some kind). For example, it may be more difficult to manufacture a mounting having a channel with a catch as compared to a guiding element with a catch.

In the embodiments describe above, the safety switch mounting 30 is described as being L-shaped. This allows the safety switch 1 to be attached to the mounting 30, and the mounting then attached to the door post 20. This also allows the length or base or bottom of the L-shaped mounting to be dimensioned to extend beyond the depth of the switch, and therefore absorb impacts from the door 21 or the actuator mounting 40. Understandably, such a construction is merely exemplary and other configurations are readily appreciated. The safety switch mounting 30 may just be a channel 32, or elongate guiding element 44, located adjacent to the safety switch 1. The safety switch mounting 30 may not be attached to the safety switch 1. Instead of a part of the safety switch mounting 30 extending beyond the depth of the safety switch 1 to absorb impacts from the door 21 (etc.), the actuator mounting 40 and safety switch mounting 30 may, together, be arranged to ensure that the safety switch 1 is not impacted. For example, a part of the actuator mounting 40 may extend further towards the safety switch 1 than is shown in the Figures, therefore negating the need for a part of the safety switch mounting 30 to extend up to or beyond the depth of the safety switch 1.

In the embodiments described above, the L-shaped safety switch mounting 30 is provided with a tapered aperture 31. The tapered aperture 31 tapers inward towards the channel 32. If there has been no rotation between the safety switch mounting 30 and the actuator mounting 40, the tapered aperture 31 guides the elongate guiding element 44 into the channel 32, which causes the actuator 10 to be brought into engagement with the safety switch. However, it will be appreciated that in some situations, the safety switch mounting 30 and the actuator mounting 40 may be rotated relative to one another. If this happens, the actuator 10 may not be brought into engagement with the safety switch 1 even if the tapered aperture 31 guides the elongate guiding element 44 into the channel 32—i.e. the actuator 10 may have been rotated out of alignment with the opening **6*b* of the safety switch 1. Therefore, the elongate guiding element 44 and/or the channel 32 may be shaped to co-operate such that, when engaged with one another, the actuator is (if applicable) rotated into alignment with the opening 6*b* of the safety switch 1. For example, one or both of the channel 32 and the elongate guiding element 44 may be provided with indexes or channels and/or elongate protrusions which urges the (or a part of the) actuator mounting 40 to rotate to the correct position for engagement with the opening 6*b* of the safety switch 1. Any suitable arrangement may be used. For example a channel and guide arrangement may be used. Alternatively, the elongate guiding element 44 and channel 32 may be elliptical in cross-section, such that the axes of the ellipses are urged to align when the elongate guiding element 44 is brought into engagement with the channel 32. Alignment of the elliptical axes will cause the rotation of the actuator mounting to bring the actuator into alignment with the opening of the safety switch 1**.

In the embodiments described above, the tapered aperture 31 is described as tapering inwardly toward a channel 32. The channel shown in the Figures is substantially elongate and straight. It is appreciated that the channel 32 may be any appropriate shape. For example, the channel 32 may also be tapered. The angle at which the channel 32 tapers may match that of the tapered aperture 31.

In the embodiments described above, the safety switch mounting 30 is described as being attached to a door post 20, and the actuator mounting 40 described as being attached to a door 21. It is appreciated that, instead, the safety switch mounting 30 maybe attached to the door 21, and the actuator mounting 40 attached to the door post 20. Similarly, the safety switch mounting 30 and actuator mounting 40 maybe attached to any suitable support structure. For example, the safety switch mounting 30 and actuator mounting 40 may be attached to any one of a door post, a gate post, a fence post, a door or a gate. The mountings 30, 40 may be attached directly to access points on machines or vehicles, or windows in enclosures or buildings.

The mounting arrangements discussed above have been described with reference to a safety switch comprising, amongst other elements, a cam arrangement, a plunger, and an elongate key-like actuator engageable with the cam arrangement. It will be appreciated that the mounting arrangements may be used with many other types of safety switches and other switches. For example, the switch may be a non-contact switch. The actuator maybe a magnet or a light source, for example. The present invention is still applicable to such switches. For example, the present invention allows accurate alignment of the actuators, as discussed above.

As described above the present invention may be particularly suited to switches which utilise and monitor multiple sets of contacts (e.g. two sets of contacts). The use a mounting arrangement as described above reduces or eliminates the possibility of false-tripping (as described above) occurring. The reduction or elimination of false-tripping may save users of the switches the inconvenience and time of having to repeatedly check and reset the switches.

In the embodiments described above, a plurality of safety contacts has been described. However, it will be appreciated that any suitable configuration of safety contacts (and even auxiliary contacts) may be employed. For example, a plunger may be provided with only a single safety contact, and not two as shown in the Figures.

It will be understood by the skilled person that a contact is a conductor which may be shaped at each of its ends, i.e. to define contact points. In the above described embodiments, the moveable safety and auxiliary contacts are conductors which extend transversely through the plunger, and protrude from both sides of the plunger. The fixed contacts are conductors fixed in position relative to the housing of the safety switch.

The plunger of the present invention has been described in relation to a safety switch having a fixed set of contacts located and fixed in position in the housing of the safety switch. The fixed contacts of the housing may be individually fixed or integral to the housing, or may form part of a safety switch contact block. The safety switch contact block is a structure that is provided with the fixed contacts (or conductors). The safety switch contact block as a whole is fixed in position into the housing. So, the fixed safety contacts (conductors) may be formed integrally with the housing, individually fixed in position in the housing, or form part of a contact block which is itself fixed in position in the housing.

It will be appreciated by a person skilled in the art that the invention is not limited to the embodiments described above, and that various modifications may be made to those and other embodiments without departing from the invention, which is defined by the claims which follow.

The invention claimed is:

1. A mounting arrangement for use with a safety switch and a safety switch actuator, the mounting arrangement comprising:

a first mounting attachable to a first support structure, and arranged to be positioned proximate the safety switch, the first mounting being provided with a tapered aperture which tapers inwardly toward a channel located in the first mounting; and a second mounting comprising:

an elongate guiding element configured to be received by the channel of the first mounting;

a surface on which the safety switch actuator is attachable, such that the safety switch actuator and elongate guiding element extend in the same direction, parallel to one another and away from the mounting; and a resilient member, via which the second mounting is attachable to a second support structure.

2. The mounting arrangement of claim 1, wherein an end of the elongate guiding element to be received by the inwardly tapered aperture.

3. The mounting arrangement of claim 1, wherein the resilient member is a spring.

4. The mounting arrangement of claim 3, wherein the spring is a helical spring.

5. The mounting arrangement of claim 1, further comprising a catch mechanism.

6. The mounting arrangement of claim 5, wherein the catch mechanism is a snap-fit arrangement.

7. The mounting arrangement of claim 5, wherein the catch mechanism includes a catch provided on the elongate guiding element.

8. The mounting arrangement of claim 7, wherein a catch receiving portion is provided in a surface defining the channel, for receiving the catch of the elongate guiding element.

9. The mounting arrangement of claim 5, wherein the catch mechanism includes a catch provided in the channel.

10. The mounting arrangement of claim 9, wherein a catch receiving portion is provided in the guiding element for receiving the catch in the channel.

11. The mounting arrangement of claim 5, wherein the catch mechanism includes a catch having a biasing element.

12. The mounting arrangement of claim 11, wherein the catch further comprises a catching member connected to the biasing element.

13. The mounting arrangement of claim 12, wherein the catching member is a ball.

14. The mounting arrangement of claim 1, wherein the first mounting and second mounting are shaped such that, when the safety switch actuator is brought into engagement with the safety switch, the first mounting comes into contact with the second mounting.

15. The mounting arrangement of claim 1, wherein the second mounting is provided with a safety switch actuator.

16. The mounting arrangement of claim 1, wherein one of the first support structure or the second support structure is one of a door post, a gate post, or a fence post and another of the first support structure or the second support structure is a door or a gate.

17. A mounting arrangement for use with a safety switch and a safety switch actuator, the mounting arrangement comprising:

a first mounting attachable to a first support structure, and arranged to be proximate the safety switch, the first mounting being provided with an elongate guiding element which extends away from the first mounting; and a second mounting comprising:

a tapered aperture which tapers inwardly toward a channel located in the second mounting, the channel being configured to receive the elongate guiding element of the first mounting;

a surface on which the safety switch actuator is attachable, such that the actuator and elongate guiding element extend in the same direction, parallel to one another and away from the mounting; and a resilient member, via which the second mounting is attachable to a second support structure.

18. A mounting arrangement for a safety switch and a safety switch actuator, the mounting arrangement comprising:

a first mount, a second mount positioned such that the safety switch and the safety switch actuator operatively cooperate when the first and second mounts are proximate one another; and a resilient member for allowing deflection of one of the safety switch and the safety switch actuator when the safety switch and the safety switch actuator and moved relative to a position wherein the safety switch actuator operatively cooperates with the safety switch.

19. The mounting arrangement of claim 18 wherein one of the first mount and the second mount includes a channel and the other of the first mount and the second mount includes a projection for guiding cooperation of the safety switch and the safety switch actuator.

20. The mounting arrangement of claim 19 further comprising an index for indicating a level of cooperation of the projection and the channel.

21. The mounting arrangement of claim 19 wherein the channel and projection initiate relative rotation between the first mount and the second mount.

* * * * *